US007849828B2

(12) United States Patent
Elnick et al.

(10) Patent No.: US 7,849,828 B2
(45) Date of Patent: Dec. 14, 2010

(54) ROCKER ARM ASSEMBLY

(75) Inventors: Rodney K. Elnick, Washington, MI (US); Ronald Jay Pierik, Holly, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 482 days.

(21) Appl. No.: 12/042,390

(22) Filed: Mar. 5, 2008

(65) Prior Publication Data

US 2009/0223473 A1 Sep. 10, 2009

(51) Int. Cl.
*F01L 1/18* (2006.01)

(52) U.S. Cl. ..... 123/90.39; 123/90.16; 74/559

(58) Field of Classification Search ..... 123/90.15, 123/90.16, 90.39; 74/559, 569
See application file for complete search history.

(56) References Cited

U.S. PATENT DOCUMENTS 7,305,951 B2 * 12/2007 Fernandez et al. ..... 123/90.39

* cited by examiner

*Primary Examiner*—Zelalem Eshete
(74) *Attorney, Agent, or Firm*—Harness, Dickey & Pierce, P.L.C.

(57) ABSTRACT

A rocker arm assembly includes a lever body having a first end defining a pivot point, a second end for engagement with a valve train and a central opening extending therethrough. An eccentric bearing is received in the central opening, the eccentric bearing having an eccentric opening therein. The eccentric opening having at least one thrust absorbing key extending radially inward from a surface of the eccentric opening. An eccentric pivot shaft is supported by the eccentric bearing, the eccentric pivot shaft including at least one radially inwardly extending slot located and sized to receive the at least one thrust absorbing key in an assembled position. A first cam follower is disposed on the eccentric bearing and second and third cam followers are each disposed on opposite ends of the eccentric pivot shaft.

20 Claims, 8 Drawing Sheets

FIG 6
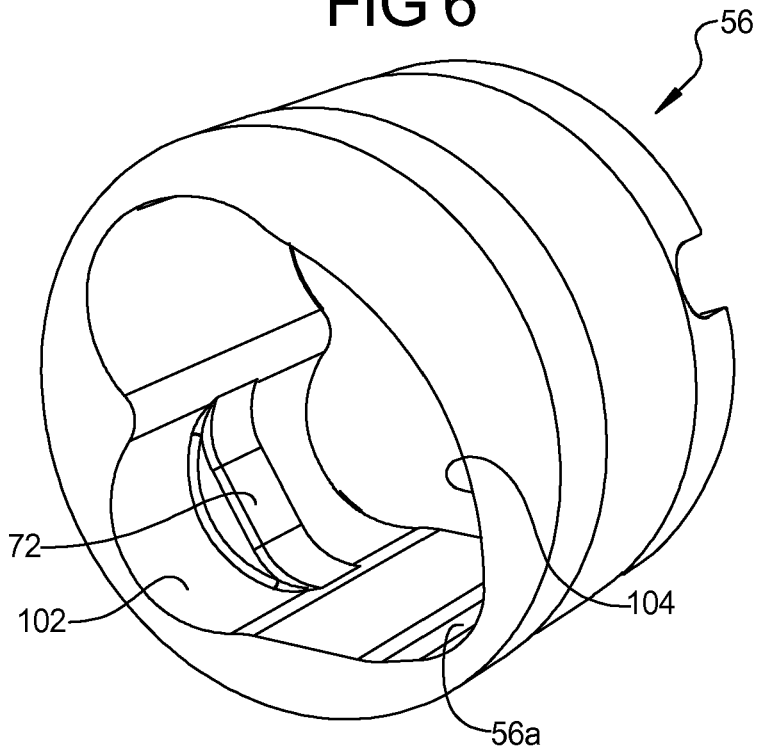
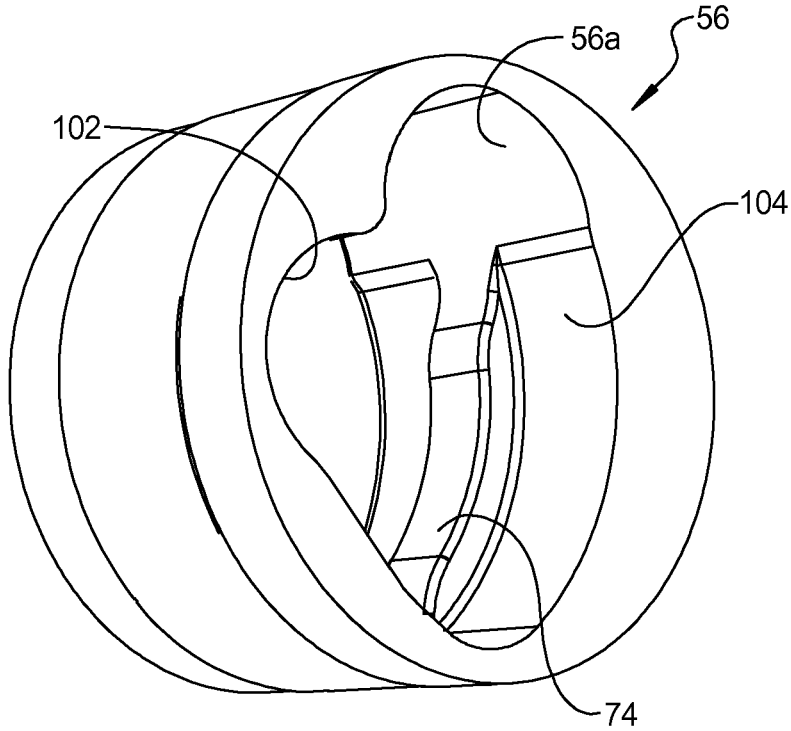
FIG 7

FIG 8b
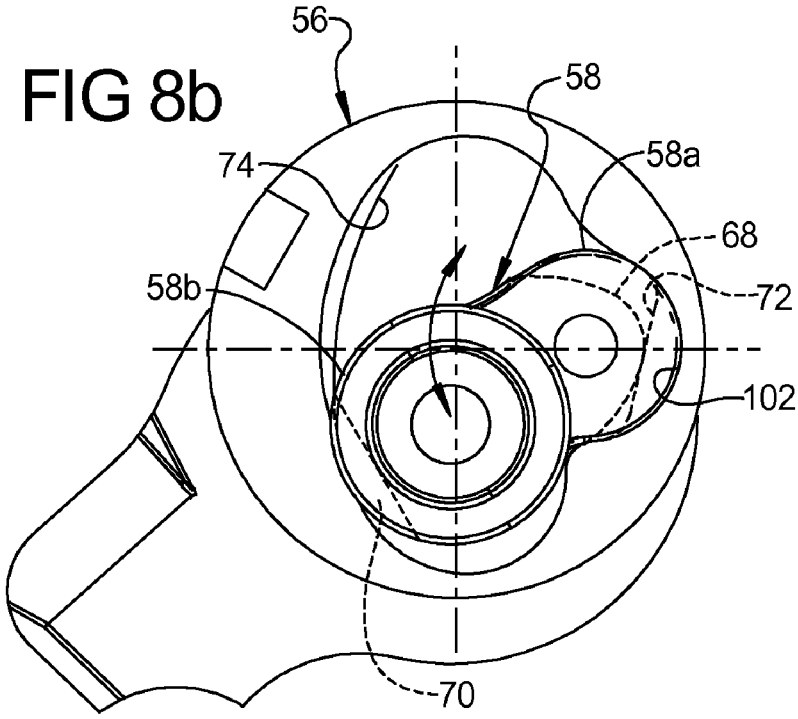
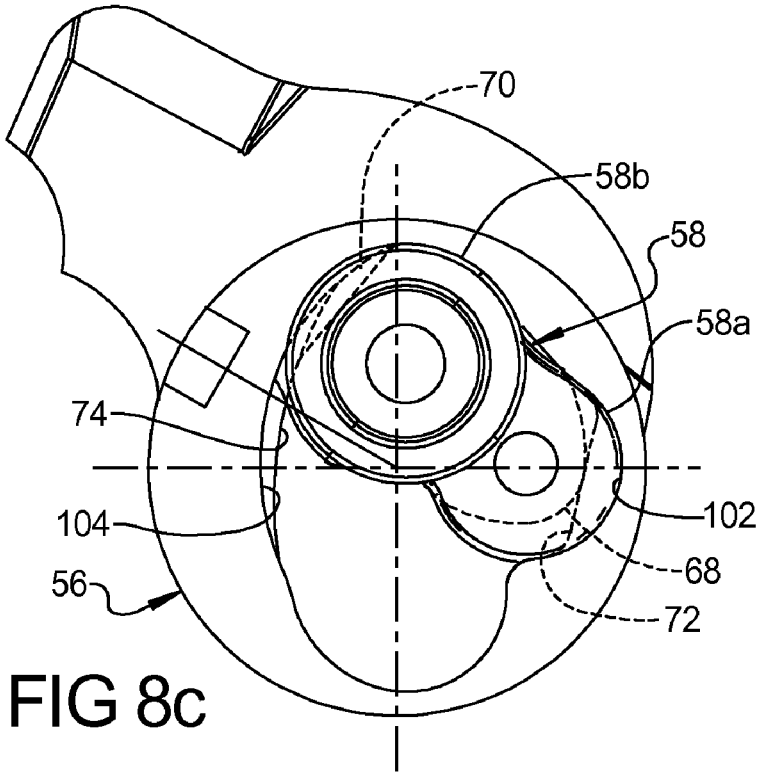
FIG 8c

ROCKER ARM ASSEMBLY

FIELD

The present disclosure relates to rocker arm assemblies, and more particularly to a rocker arm assembly.

BACKGROUND

The statements in this section merely provide background information related to the present disclosure and may not constitute prior art.

Internal combustion engines include an arrangement of pistons and cylinders located within an engine block. Each cylinder has at least two valves. These valves control the flow of air to the combustion cylinders and allow for venting of combustion exhaust gasses. A valve train is used to selectively open and close these valves. In some valve trains, it is desirable to control the degree that the valves are opened or closed (i.e., the amount the valve travels). In order to selectively control the valve lift, the rocker arm assembly is connected to the valve and actuated by a camshaft.

A typical rocker arm assembly includes an inner and an outer rocker arm actuated by the camshaft. The camshaft typically includes a low-lift cam and a high-lift cam. The camshaft engages the inner and outer rollers of the rocker arm assembly which, in turn, selectively positions the connected valve between a low-lift mode and a high-lift mode. The low-lift mode causes the valve to travel a first distance and a high-lift mode causes the valve to travel a second distance that is greater than the first distance. While useful for its intended purpose, there is room in the art for an improved rocker arm assembly having improved features to aid in durability.

SUMMARY

A rocker arm assembly is provided including a lever body having a first end defining a pivot point, a second end for engagement with a valve train and a central opening extending therethrough. An eccentric bearing is received in the central opening. The eccentric bearing has an eccentric opening therein. The eccentric opening has at least one thrust absorbing key extending radially inward from a surface of the eccentric opening. An eccentric pivot shaft is supported by the eccentric bearing, the eccentric pivot shaft includes at least one radially inwardly extending slot located and sized to receive the at least one thrust absorbing key in an assembled position. A first cam follower is disposed on the eccentric bearing and second and third cam followers are each disposed on opposite ends of the eccentric pivot shaft.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 4B:
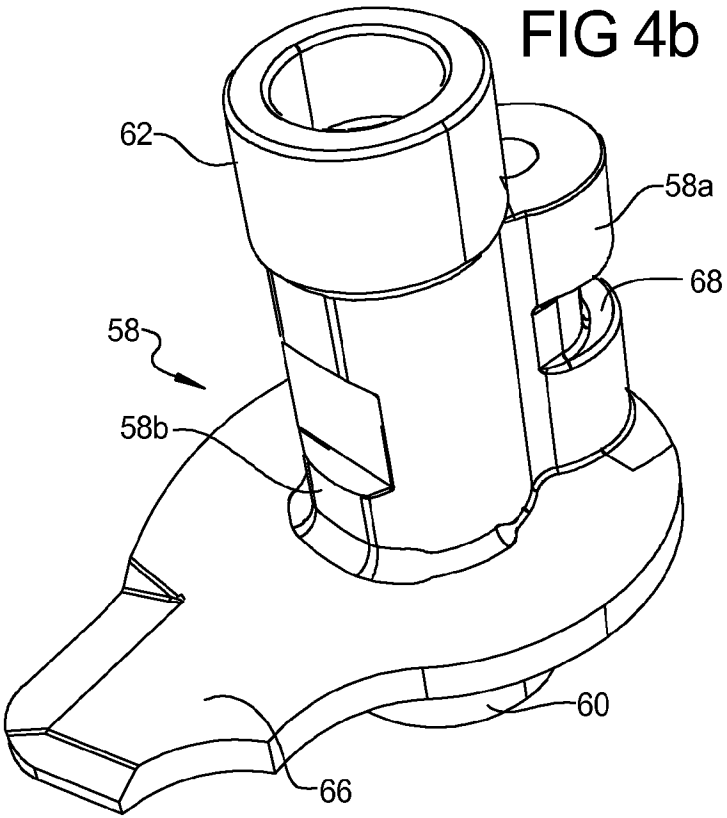
Figure 4A:
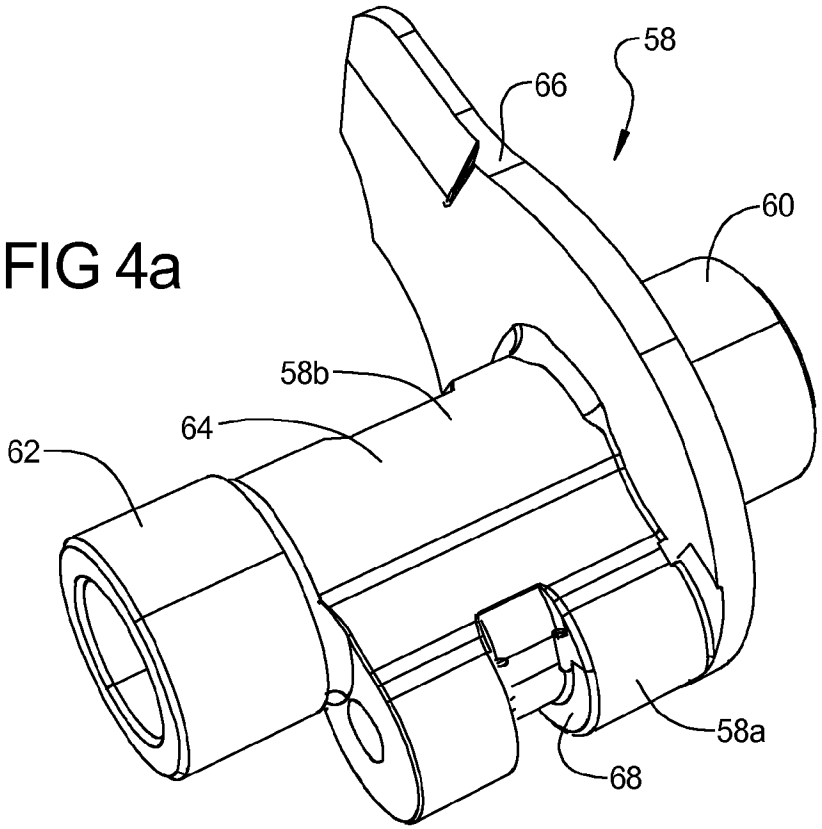

FIG. 4*a* is a perspective view of an eccentric pivot shaft of the rocker arm assembly;

FIG. 4*b* is a perspective view from a different angle of the eccentric pivot shaft shown in FIG. 4*a;*

Figure 5:
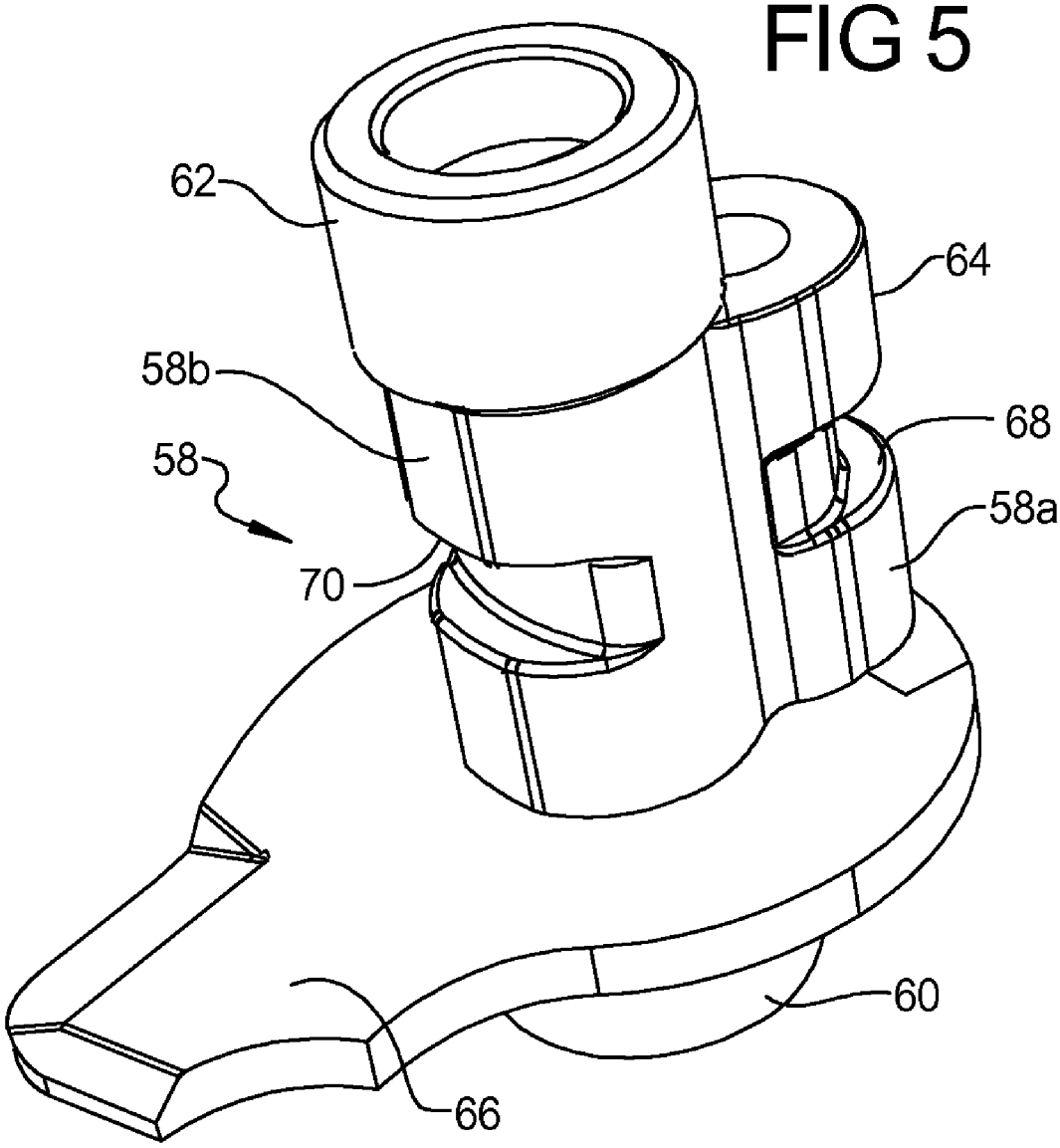
Figure 8A:
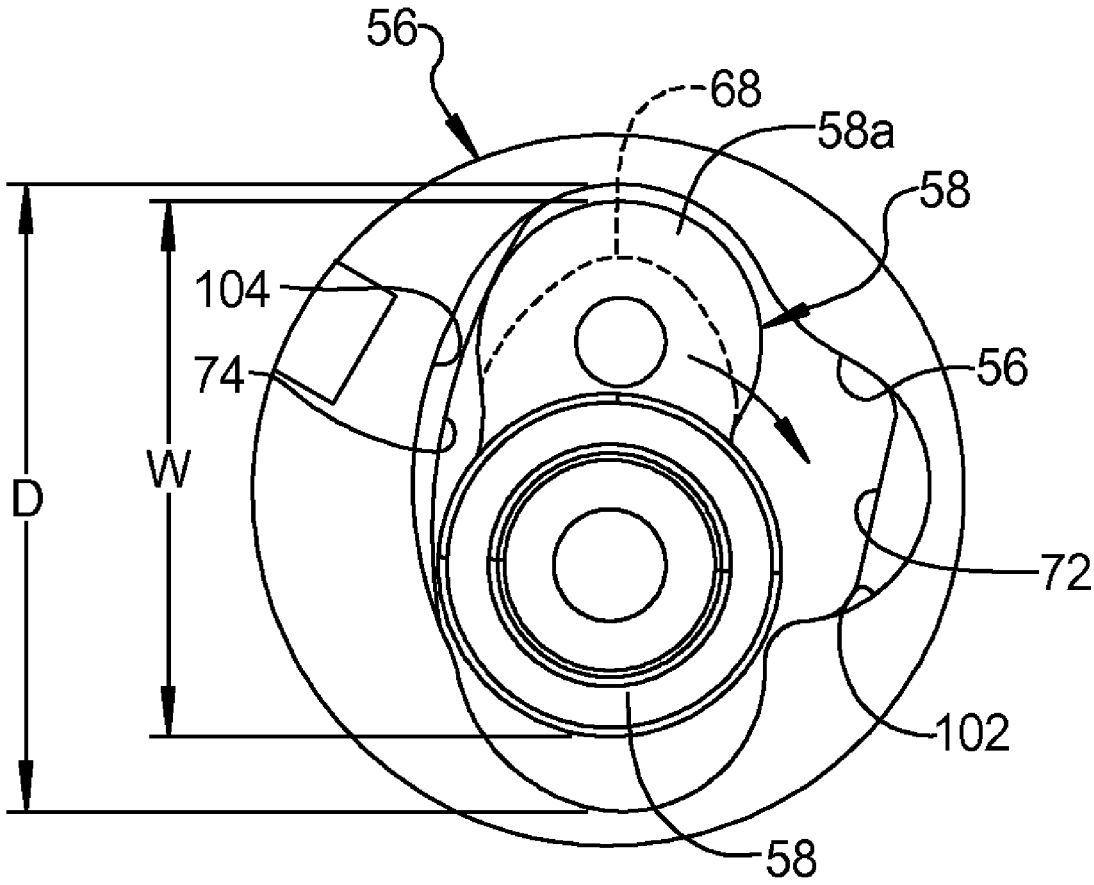

FIG. 5 is a perspective view of an alternative eccentric pivot shaft;

FIG. 6 is a perspective view of an eccentric bearing for use with the rocker arm assembly;

FIG. 7 is a perspective view of the eccentric bearing taken from a different angle;

FIG. 8*a* is a side view illustrating the orientation of the eccentric pivot shaft relative to the eccentric bearing when the pivot shaft is axially inserted into the eccentric bearing;

FIG. 8*b* is a side view illustrating the orientation of the eccentric pivot shaft relative to the eccentric bearing when the rocker arm assembly is in a low-lift mode; and FIG. 8*c* is a side view illustrating the position of the eccentric pivot shaft relative to the eccentric bearing when the rocker arm assembly is in the high-lift mode.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 1:
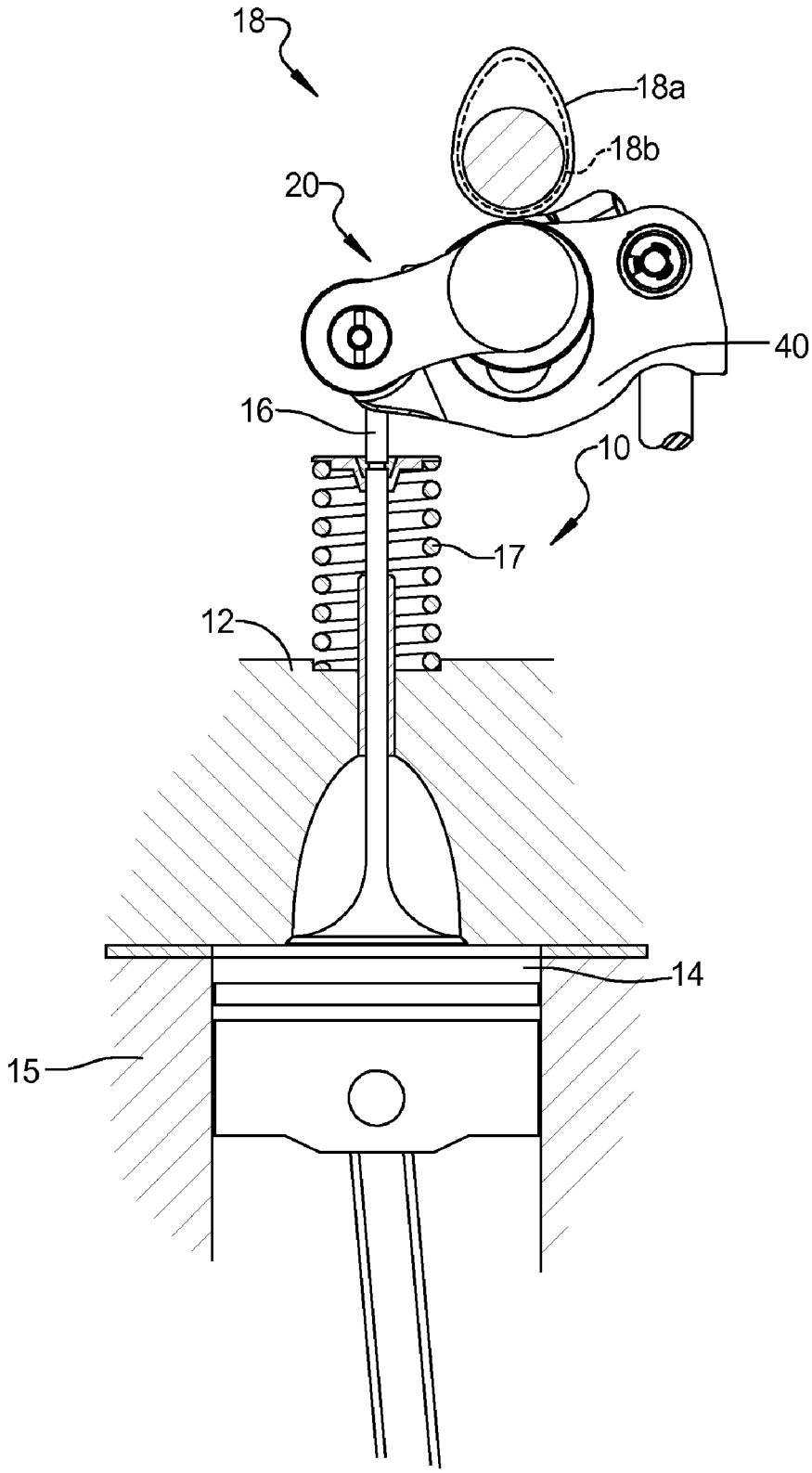
FIG. 1 is a schematic view of a rocker arm assembly according to the principles of the present disclosure shown in an exemplary engine.

With reference to FIG. 1, an exemplary internal combustion engine is shown as indicated by reference numeral 10. The internal combustion engine 10 generally includes a cylinder head 12 that caps a plurality of cylinders 14 within the engine block 15 of the engine 10. A valve train is mounted to the cylinder head 12. The valve train generally includes a valve 16, a rocker arm assembly 20, and a camshaft 18. The valve 16 extends through the cylinder head 12 and into one of the cylinders of the engine 10. The valve 16 is operable to selectively open and close to allow intake air to enter the cylinder 14 (in the case of an intake valve) or to allow exhaust to exit the cylinder 14 (in the case of an exhaust valve). The valve 16 is biased into the closed position by a valve spring 17. The camshaft 18 can be mounted to the cylinder head. The camshaft 18 includes first and second high-lift cams 18*a*, and a low-lift cam 18*b* located between the first and second high-lift cams 18*a*. The rocker arm assembly 20 is located beneath the camshaft 18 and is coupled to the valve 16 at one end by a valve pad and coupled to the cylinder head 12 at an opposite end. As is known in the art, the camshaft 18 is operable to engage the rocker arm assembly 20 to selectively open and close the valve 16.

Figure 2:
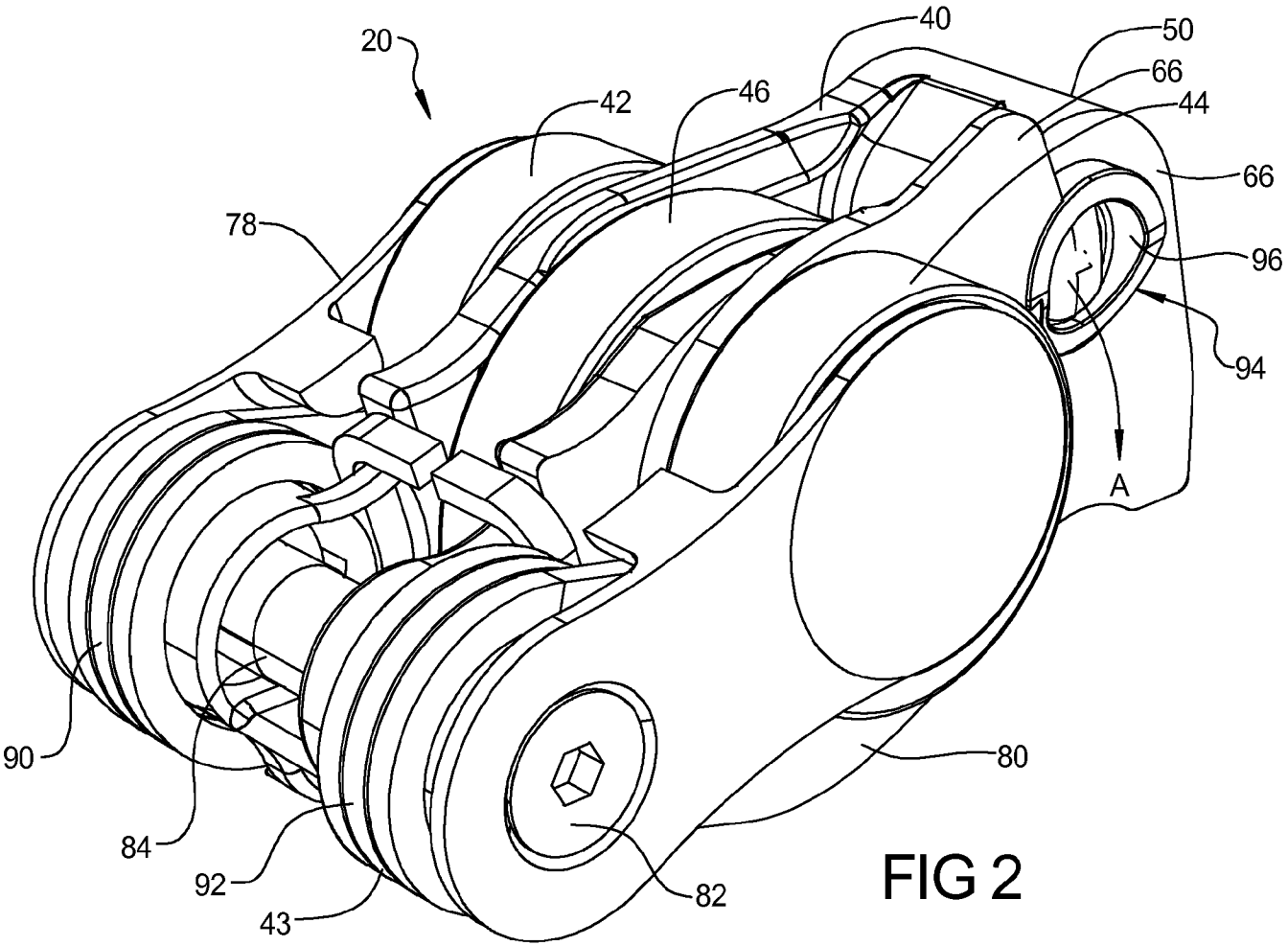
FIG. 2 is a perspective view of a rocker arm assembly according to the principals of the present disclosure.
Figure 3:
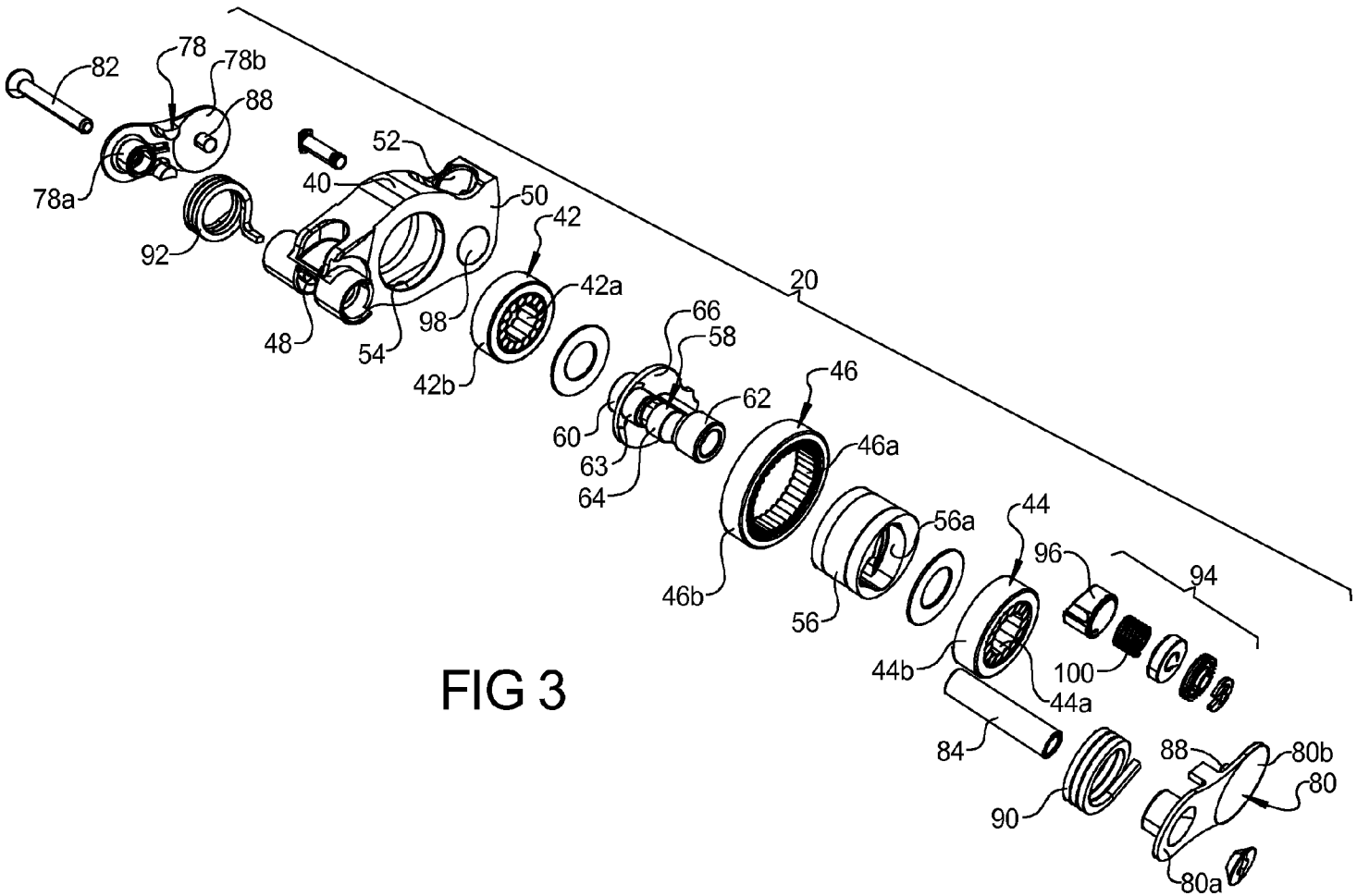
FIG. 3 is an exploded perspective view of the exemplary rocker arm assembly according to the principles of the present disclosure.

Turning to FIGS. 2 and 3, the rocker arm assembly 20 will now be generally described, followed by a more detailed description of specific components. The rocker arm assembly 20 may be a multi-step rocker arm assembly, for example, a two-step rocker arm assembly. The rocker arm assembly 20 has two steps or modes of operation that allow selective opening of the valve 16, as will be described in greater detail below. The rocker arm assembly 20 generally includes a lever body 40 that supports a first roller assembly 42, a second roller assembly 44 and a third roller assembly 46 which each define cam followers. The roller assemblies 42, 44 and 46 are preferably roller bearings having inner bearing assemblies 42*a*, 44*a* and 46*a* and an outer roller 42*b*, 44*b* and 46*b* riding on the inner bearing assembly, but it should be appreciated that various other kinds of bearing assemblies or follower pads may be employed without departing from the scope of the present disclosure.

The lever body 40 includes a pivot end 50 about which the rocker arm assembly 20 pivots, and a second end 48 which engages a valve member or other member of the valve train. The pivot end 50 includes a hemispherical recess 52 pivotally coupled to the cylinder head 12. The lever body 40 is also provided with a center opening 54 that receives an eccentric bearing 56. The eccentric bearing 56 includes an eccentric opening 56*a*. An eccentric pivot shaft 58 is supported in the eccentric opening 56*a* of the eccentric bearing 56. The eccentric pivot shaft 58 includes a pair of end supports 60, 62 that support the first and second roller assemblies 42, 44. The eccentric pivot shaft 58 also includes an intermediate eccentric portion 64 which is received within the eccentric opening 56*a* of the eccentric bearing 56. The eccentric pivot shaft 58 also includes a latch arm 66 disposed between the end portion 60 and intermediate portion 64. The intermediate portion 64 includes at least one radially inwardly extending slot 68 as best illustrated in FIGS. 4*a* and 4*b*. Alternatively, as illustrated in FIG. 5, the intermediate portion of the eccentric pivot shaft 58' can include a pair of radially inwardly extending slots 68, 70.

As shown in FIG. 6, the eccentric opening 56*a* of the eccentric bearing 56 provides an assembly clearance for inserting the eccentric pivot shaft 58 therein. The eccentric opening 56*a* has at least one thrust absorbing key 72 extending radially inward from the inner surface of the eccentric opening 56*a*. During assembly, the intermediate portion 64 of the eccentric pivot shaft 58 is inserted into the eccentric opening 56*a* and is rotated to cause the key 72 to enter the slot 68 in the intermediate portion 64 of the eccentric pivot shaft 58. As illustrated in FIG. 7, the eccentric bearing 56 can include a second key 74, circumferentially or alternatively axially spaced from the first key 72, which can be received in the second groove 70 of the intermediate portion of the eccentric pivot shaft 58' as illustrated in FIG. 5. The ability to use one or possibly two keys 72, 74 for receipt in corresponding recessed slots 68, 70 in the eccentric pivot shaft 58 can provide a balancing of the forces on opposite sides of the eccentric pivot shaft 58. Alternatively, it should be understood that the keys can be disposed on the eccentric pivot shaft and the slots can be disposed in the interior surface of the eccentric bearing.

FIG. 8*a* shows the eccentric pivot shaft 58 inserted in the eccentric opening 56*a* of the eccentric bearing 56. In the position shown in FIG. 8*a*, the eccentric pivot shaft 58 has clearance to move axially in and out of the bearing 56. In other words, diameter dimension D of the eccentric opening is larger than the width dimension W of the intermediate portion 64 of the pivot shaft 58 so that the pivot shaft 58 has clearance to be inserted axially into the eccentric opening 56*a*. The width and other dimensions are also required for the pivot shaft 58 to fit through the eccentric bearing opening 56*a*.

FIG. 8*b* shows the eccentric pivot shaft 58 in a first position wherein a pivot portion 58*a* of pivot shaft 58 is received in a pivot receiving lobe 102 of the eccentric opening 56*a*. In the position illustrated in FIG. 8*b*, the pivot shaft 58 is in a low-lift mode, with the keys 72 and 74 of the eccentric bearing 56 received in the slots 68 and 70 of the pivot shaft 58.

The pivot shaft 58 is pivotable in a lost motion slot portion 104 of the eccentric opening 56*a* to a high-lift mode position as shown in FIG. 8*c*. In this position, the eccentric portion 58*b* of the pivot shaft 58 is disposed in an upper end of the lost motion slot portion 104 of the eccentric opening 56*a*.

With reference to FIGS. 2 and 3, a pair of spring arms 78, 80 are disposed on opposite sides of the rocker arm assembly 20. The spring arms 78, 80 are mounted to a pivot shaft in the form of a fastener 82 and pivot sleeve 84 extending through the second end 48 of the lever body 40. The spring arms 78, 80 each include a pivot end 78*a*, 80*a* mounted to the pivot sleeve 84 and a second end 78*b*, 80*b* which includes a guide boss 88 engaging corresponding recesses in the ends of the pivot shaft 58 for securing the first and second roller assemblies 42, 44 in place. A pair of torsion springs 90, 92 are mounted to the pivot sleeve 84 and provide a biasing force for biasing the spring arms 78, 80 in the direction of the cam lobes. A locking mechanism 94, including a retractable pin 96, is provided for maintaining the latch arm 66 of the pivot shaft 58 in a fixed position as illustrated in FIG. 2. The locking mechanism 94 is received in an aperture 98 provided in the lever body 40. The locking mechanism 94 includes a spring 100 for biasing the pin 96 to an extended position as illustrated in FIG. 1. The latch arm 66 of the pivot shaft 58 securely holds the first roller assembly 42 and second roller assembly 44 in firm engagement with the high-mode cam lobes for operation in a high-lift mode. When the lock mechanism 94 is retracted, the latch arm 66 is allowed to pivot in the direction of arrow A in FIG. 2 so that the center roller bearing 46 provides the cam action of the rocker arm assembly 20 while the roller bearings 42, 44 are able to pivot against the bias of the spring force of torsion springs 90, 92.

The keys 72, 74 on the interior surface of the eccentric bearing 56 are received in the recessed slots, 68, 70 counteract dynamic axial forces within the rocker arm assembly 20 to isolate the axial forces away from the spring arms 78, 80 and therefore provides greater durability to the rocker arm assembly 20. It should be understood that either one of the keys 72, 74 and recessed slots 68, 70 can be utilized alone or that two or more of the keys and slots can be used together to isolate the axial forces away from the spring arms 78, 80.

What is claimed is:

1. A rocker arm assembly, comprising:

a lever body having a first end defining a pivot point, a second end for engagement with a valve train and a central opening extending therethrough;

an eccentric bearing received in the central opening, the eccentric bearing having an eccentric opening therein;

an eccentric pivot shaft supported by the eccentric bearing, wherein one of the eccentric pivot shaft and the eccentric opening having at least one thrust absorbing key extending from a surface thereof and the other of the eccentric pivot shaft and the eccentric opening includes at least one radially extending slot located and sized to receive the at least one thrust absorbing key in an assembled position;

a first cam follower disposed on the eccentric bearing; and second and third cam followers each disposed on opposite ends of the eccentric pivot shaft.

2. The rocker arm assembly according to claim 1, wherein the thrust absorbing key inhibits axial movement of the eccentric pivot shaft relative to the eccentric bearing.

3. The rocker arm assembly according to claim 1, wherein the at least one thrust absorbing key includes a pair of thrust absorbing keys spaced from one another and the at least one slot includes a pair of slots spaced from one another and sized to receive the pair of thrust absorbing keys in an assembled position.

4. The rocker arm assembly according to claim 1, wherein the eccentric opening in the eccentric bearing is sized and configured to axially receive the eccentric pivot shaft in a first orientation and the eccentric pivot shaft is pivotable relative to the eccentric bearing to the assembled position wherein the at least one slot engages the at least one thrust absorbing key.

5. The rocker arm assembly according to claim 1, wherein the first cam follower is a roller assembly.

6. The rocker arm assembly according to claim 1, wherein the second cam follower and the third cam follower include roller assemblies.

7. The rocker arm assembly according to claim 1, further comprising a pair of arms attached to the second end of the lever body which entrap the second follower and the third follower at axial ends of the eccentric pivot shaft.

8. An engine, comprising:

an engine block defining a plurality of cylinders;

a plurality of pistons disposed in respective ones of said cylinders;

a cylinder head mounted to said engine block;

a plurality of valve members disposed in said cylinder head;

a camshaft supported by one of the engine block and the cylinder head; and a valve train disposed between the camshaft and the plurality of valve members, the valve train including a plurality of rocker arms including:

a lever body having a first end defining a pivot point, a second end for engagement with a valve train and a central opening extending therethrough;

an eccentric bearing received in the central opening, the eccentric bearing having an eccentric opening therein, the eccentric opening having at least one thrust absorbing key extending radially inward from a surface of the eccentric opening;

an eccentric pivot shaft supported by the eccentric bearing, the eccentric pivot shaft including at least one radially inwardly extending slot located and sized to receive the at least one thrust absorbing key in an assembled position;

a first cam follower disposed on the eccentric bearing; and second and third cam followers each disposed on opposite ends of the eccentric pivot shaft.

9. The engine according to claim 8, wherein the thrust absorbing key inhibits axial movement of the eccentric pivot shaft relative to the eccentric bearing.

10. The engine according to claim 8, wherein at least one thrust absorbing key includes a pair of thrust absorbing keys spaced from one another and the at least one inwardly extending slot includes a pair of inwardly extending slots spaced from one another and sized to receive the pair of thrust absorbing keys in an assembled position.

11. The engine according to claim 8, wherein the eccentric opening in the eccentric bearing is sized and configured to axially receive the eccentric pivot shaft in a first orientation and the eccentric pivot shaft is pivotable relative to the eccentric bearing to the assembled position wherein the at least one slot of the eccentric pivot shaft engages the at least one thrust absorbing key.

12. The engine according to claim 8, wherein the first cam follower is a roller assembly.

13. The engine according to claim 8, wherein the second cam follower and the third cam follower include roller assemblies.

14. The engine according to claim 8, further comprising a pair of arms attached to the second end of the lever body which entrap the second follower and the third follower at axial ends of the eccentric pivot shaft.

15. A rocker assembly, comprising a lever body having a first end defining a pivot point, a second end for engagement with a valve train and a central opening extending therethrough;

an eccentric bearing received in the central opening, the eccentric bearing having an eccentric opening therein, the eccentric opening having at least one thrust absorbing key extending radially inward from a surface of the eccentric opening;

an eccentric pivot shaft supported by the eccentric bearing, the eccentric pivot shaft including at least one radially inwardly extending slot located and sized to receive the at least one thrust absorbing key in an assembled position;

a first cam follower disposed on the eccentric bearing; and second and third cam followers each disposed on opposite ends of the eccentric pivot shaft.

16. The rocker arm assembly according to claim 15, wherein the thrust absorbing key inhibits axial movement of the eccentric pivot shaft relative to the eccentric bearing.

17. The rocker arm assembly according to claim 15, wherein the at least one thrust absorbing key includes a pair of thrust absorbing keys spaced from one another and the at least one inwardly extending slot includes a pair of inwardly extending slots spaced from one another and sized to receive the pair of thrust absorbing keys in an assembled position.

18. The rocker arm assembly according to claim 15, wherein the eccentric opening in the eccentric bearing is sized and configured to axially receive the eccentric pivot shaft in a first orientation and the eccentric pivot shaft is pivotable relative to the eccentric bearing to the assembled position wherein the at least one slot of the eccentric pivot shaft engages the at least one thrust absorbing key.

19. The rocker arm assembly according to claim 15, wherein the first cam follower is a roller assembly.

20. The rocker arm assembly according to claim 15, further comprising a pair of arms attached to the second end of the lever body which entrap the second follower and the third follower at axial ends of the eccentric pivot shaft.

* * * * *